US010249166B1

(12) United States Patent
Carter

(10) Patent No.: US 10,249,166 B1
(45) Date of Patent: Apr. 2, 2019

(54) CHILD TRACKING SYSTEM

(71) Applicant: Michael Carter, Kremmling, CO (US)

(72) Inventor: Michael Carter, Kremmling, CO (US)

( * ) Notice: Subject to any disclaimer, the term of this patent is extended or adjusted under 35 U.S.C. 154(b) by 0 days.

(21) Appl. No.: 15/805,868

(22) Filed: Nov. 7, 2017

(51) Int. Cl.
*G08B 21/02* (2006.01)
*G08B 6/00* (2006.01)

(52) U.S. Cl.
CPC ..... *G08B 21/0269* (2013.01); *G08B 6/00* (2013.01); *G08B 21/0283* (2013.01); *G08B 21/0288* (2013.01); *G08B 21/0294* (2013.01)

(58) Field of Classification Search
CPC ..... G08B 21/0288; G08B 25/016
USPC ..... 340/539.13
See application file for complete search history.

(56) References Cited

U.S. PATENT DOCUMENTS

D423,389 S 4/2000 Boyd
6,278,370 B1 8/2001 Underwood
7,602,303 B2 10/2009 Douglas et al.
8,508,361 B2 8/2013 Paolini
9,129,503 B2 9/2015 Borlenghi
9,715,819 B1 * 7/2017 Stockdale ..... G08B 25/016
9,747,770 B1 * 8/2017 Bartlett ..... G08B 21/0269
2002/0005783 A1 * 1/2002 Irizarry ..... G08B 13/2408 340/572.1
2005/0020274 A1 1/2005 Ursini
2007/0247307 A1 * 10/2007 Riep ..... G08B 21/0202 340/539.13
2010/0238033 A1 9/2010 Blumel et al.
2010/0267361 A1 10/2010 Sullivan
2013/0309963 A1 * 11/2013 Shasha ..... H04M 1/72547 455/39
2015/0109126 A1 * 4/2015 Crawford ..... G08B 21/0269 340/539.13

FOREIGN PATENT DOCUMENTS

WO WO2014072672 5/2014

* cited by examiner

*Primary Examiner* — Fabricio R Murillo Garcia

(57) ABSTRACT

A child tracking system includes an electronic device that may be manipulated by a first user. The electronic device has a first transceiver and the first transceiver is in electrical communication with an extrinsic communication network. A tracking unit is provided and the tracking unit is worn on a second user. The tracking unit has a second transceiver and the second transceiver is in remote communication with the electronic device via the extrinsic communication network. The tracking unit selectively transmits a first signal to the electronic device to alert the first user that the second user needs assistance. The tracking unit selectively transmits a second signal to emergency responders via the extrinsic communication network to notify the emergency responders that the second user needs assistance.

10 Claims, 4 Drawing Sheets

CHILD TRACKING SYSTEM

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

(2) Description of Related Art Including Information Disclosed Under 37 CFR 1.97 and 1.98

The disclosure and prior art relates to tracking devices and more particularly pertains to a new tracking device for tracking a child in a public area.

BRIEF SUMMARY OF THE INVENTION

An embodiment of the disclosure meets the needs presented above by generally comprising an electronic device that may be manipulated by a first user. The electronic device has a first transceiver and the first transceiver is in electrical communication with an extrinsic communication network. A tracking unit is provided and the tracking unit is worn on a second user. The tracking unit has a second transceiver and the second transceiver is in remote communication with the electronic device via the extrinsic communication network. The tracking unit selectively transmits a first signal to the electronic device to alert the first user that the second user needs assistance. The tracking unit selectively transmits a second signal to emergency responders via the extrinsic communication network to notify the emergency responders that the second user needs assistance.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
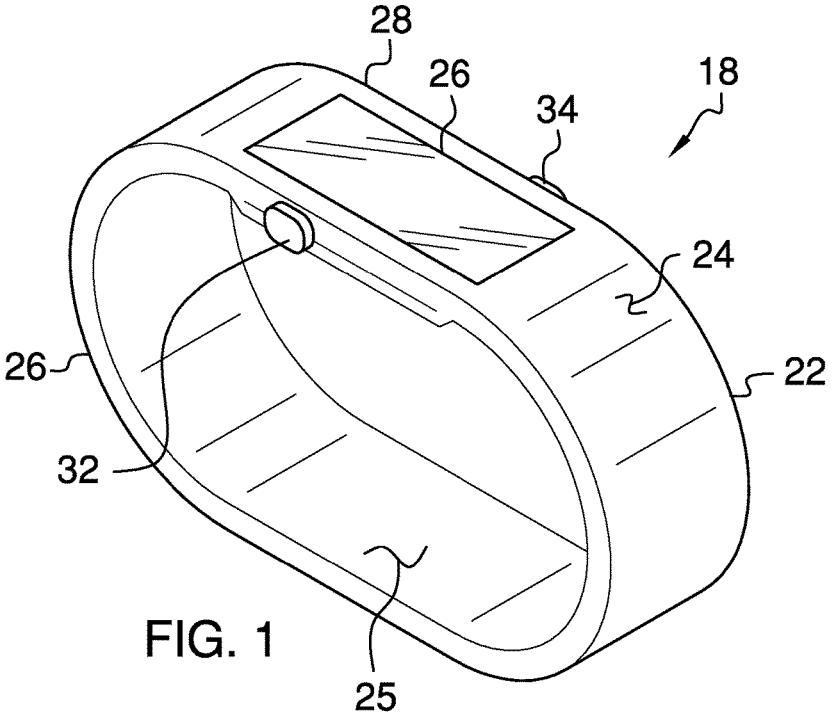
FIG. 1 is a perspective view of a tracking unit of a child tracking system according to an embodiment of the disclosure.
Figure 2:
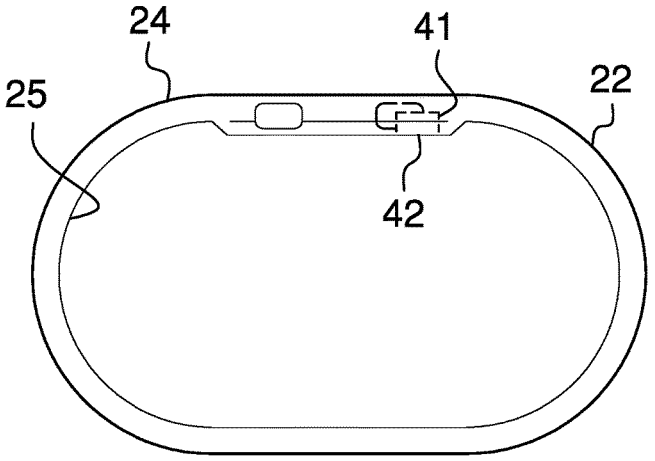
FIG. 2 is a right side view of a tracking unit of an embodiment of the disclosure.
Figure 3:
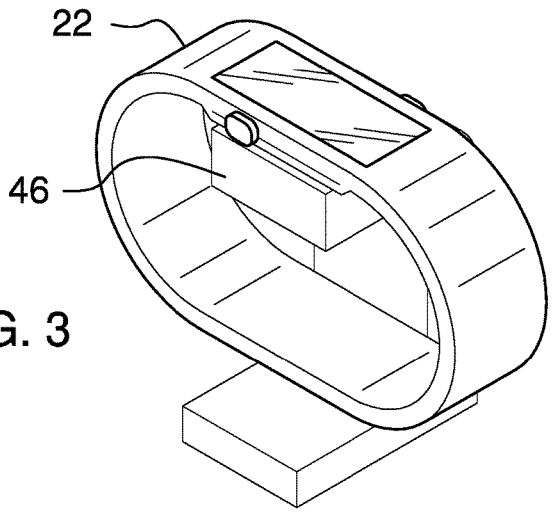
FIG. 3 is a perspective view of an embodiment of the disclosure.
Figure 4:
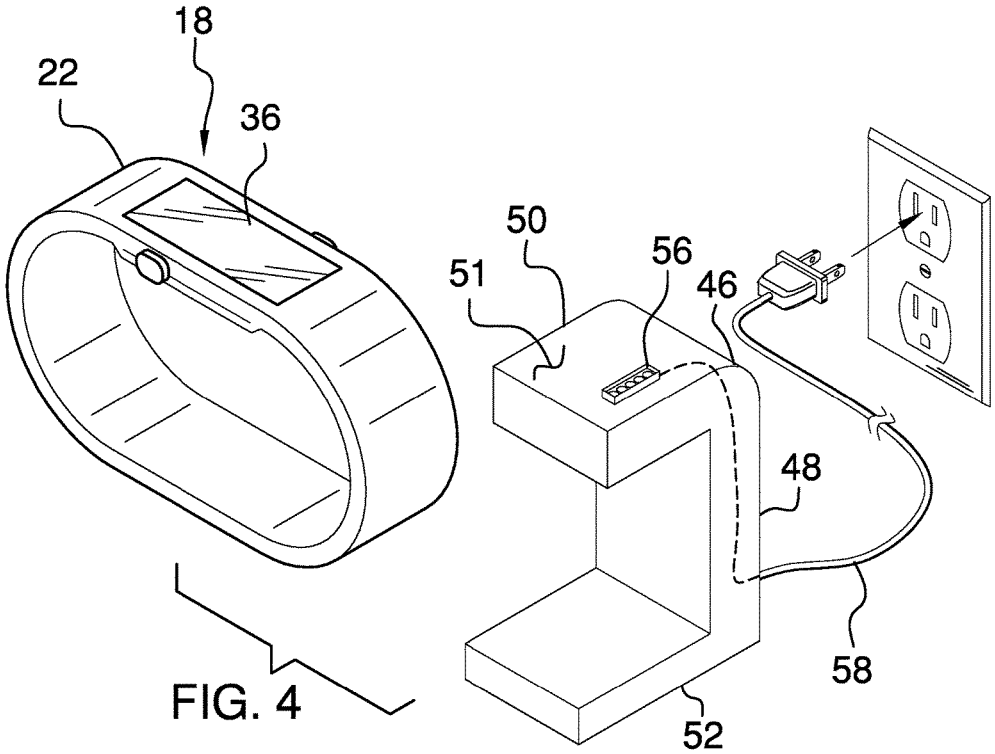
FIG. 4 is an exploded perspective view of an embodiment of the disclosure.
Figure 5:
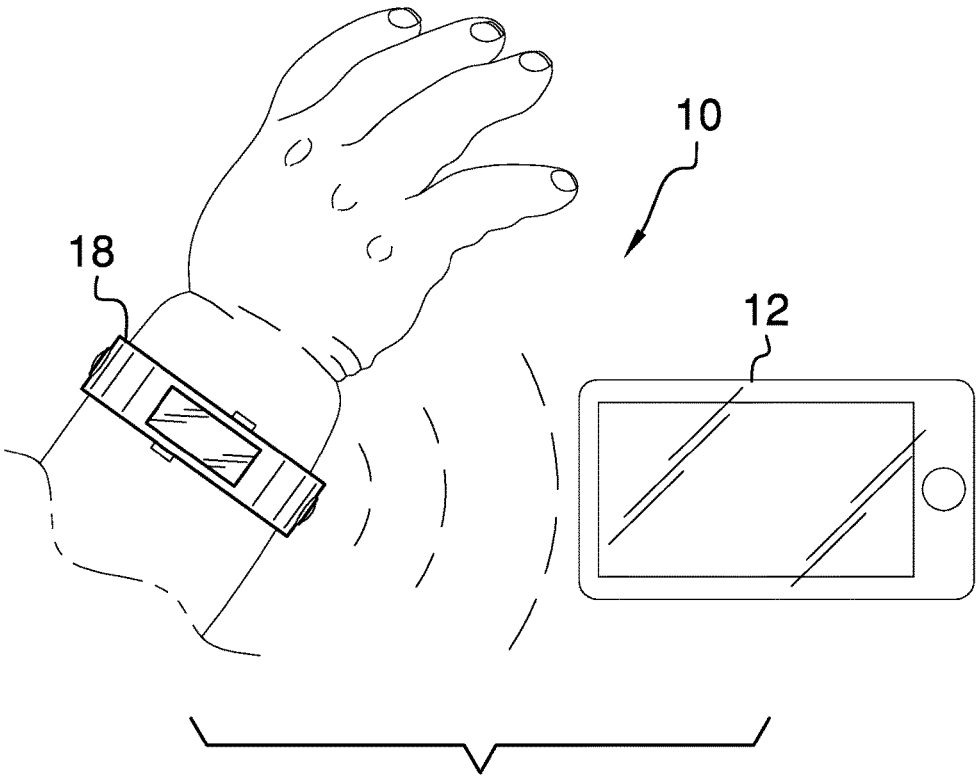
FIG. 5 is a perspective in-use view of an embodiment of the disclosure.
Figure 6:
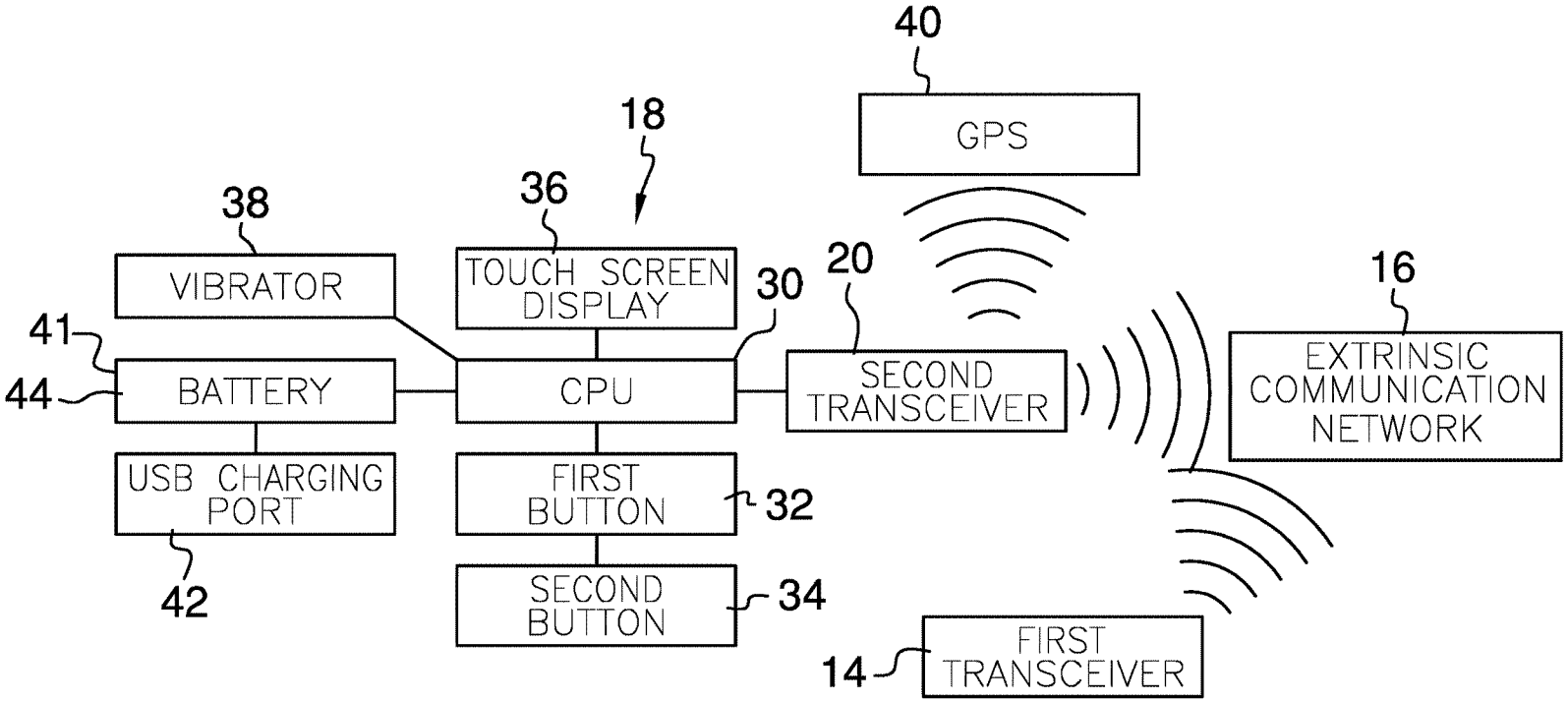
FIG. 6 is a schematic view of an embodiment of the disclosure.

With reference now to the drawings, and in particular to FIGS. 1 through 6 thereof, a new tracking device embodying the principles and concepts of an embodiment of the disclosure and generally designated by the reference numeral 10 will be described.

As best illustrated in FIGS. 1 through 6, the child tracking system 10 generally comprises an electronic device 12 that may be manipulated by a first user. The electronic device 12 has a first transceiver 14 and the first transceiver 14 is electrical communication with an extrinsic communication network 16. The extrinsic communication network 16 may be the internet, a cellular phone network and any other electronic communication network. Moreover, the electronic device 12 may be a smart phone or the like and the first transceiver 14 may be a radio frequency transceiver or the like.

A tracking unit 18 is provided and the tracking unit 18 is selectively worn on a second user. The second user may be a child and the first user may be the child's parent or other guardian. The tracking unit 18 has a second transceiver 20 that is in electrical communication with the extrinsic communication network 16. Moreover, the tracking unit 18 is in remote communication with the electronic device 12 via the extrinsic communication network 16.

The tracking unit 18 selectively transmits a first signal to the electronic device 12 to alert the first user that the second user needs assistance. The tracking unit 18 selectively transmits a second signal to emergency responders via the extrinsic communication network 16. In this way the tracking unit 18 notifies the emergency responders that the second user needs assistance. The emergency responders may be local police or other emergency responders contacted via 911.

The tracking unit 18 comprises a band 22 that is worn on a wrist. The band 22 has an outwardly facing surface 24, an inwardly facing surface 25, a first lateral side 26 and a second lateral side 28. A processor 30 is positioned within the band 22 and the processor 30 selectively generates a first alert sequence and a second alert sequence. The processor 30 may be an electronic processor 30 or the like.

A first button 32 is movably coupled to the first lateral side 26 of the band 22 and the first button 32 is selectively manipulated. The first button 32 is electrically coupled to the processor 30. The processor 30 generates the first alert sequence when the first button 32 is depressed for a minimum duration of time. The minimum duration of time may be approximately 5.0 seconds. A second button 34 is movably coupled to the second lateral side 28 of the band 22 and the second button 34 is selectively manipulated. The second button 34 is electrically coupled to the processor 30 and the second button 34 may turn the processor 30 on and off. The processor 30 generates the second alert sequence when the second button 34 is depressed in conjunction with the first button 32.

A touch screen 36 is coupled to the outwardly facing surface 24 and the touch screen 36 is selectively manipulated. The touch screen 36 is electrically coupled to the processor 30 thereby facilitating the touch screen 36 to control operational parameters of the processor 30. The touch screen 36 displays indicia corresponding to operational parameters of the processor 30. Moreover, the touch screen 36 may be an LED touch screen 36 or the like.

A vibrating unit 38 is positioned within the bracelet. The vibrating unit 38 frictionally engages the bracelet to provide haptic feedback to the second user when the band 22 is worn. The vibrating unit 38 is electrically coupled to the processor 30. Moreover, the processor 30 turns the vibrating unit 38 on when the processor 30 generates the first alert sequence and the second alert sequence. The vibrating unit 38 may be an oscillating vibrator and any other electronic vibrator.

The second transceiver 20 is positioned within the band 22 and the second transceiver 20 is electrically coupled to the processor 30. The second transceiver 20 is in electrical communication with a global positioning system (gps) thereby facilitating the second transceiver 20 to receive a physical location of the band 22 from the gps 40. The second transceiver 20 communicates the physical location of the band 22 to the first transceiver 14 when the processor 30 generates the first alert sequence. Additionally, the second transceiver 20 communicates the physical location of the band 22 to the emergency responders when the processor 30 generates the second alert sequence. The second transceiver 20 may be a radio frequency transceiver or the like and the second transceiver 20 may employ a WPAN signal. Moreover, the second transceiver 20 may be linked to the first transceiver 14 through any conventional digital communication protocols, including but not being limited to, Bluetooth protocols, cellular phone protocols and internet connectivity protocols.

A power supply 41 is coupled to the band 22 and the power supply 41 is electrically coupled to the processor 30. The power supply 41 comprises a first charge port 42 and a battery 44. The first charge port 42 is coupled to the inwardly facing surface 25 of the band 22. The battery 44 is positioned within the band 22 and the battery 44 is electrically coupled to the first charge port 42. The first charge port 42 charges the battery 44 when the first charge port 42 is electrically coupled to a power source.

A charger 46 is provided and the charger 46 has a first member 48 extending between a top member 50 and bottom member 52. The top 50 and bottom 52 members extend away from the first member 48 such that the charger 46 has a U-shape. The bottom member 52 is positioned on a support surface 54 having the top member 50 being spaced from the support surface 54. The top member 50 has an outwardly facing surface 51 and a second charge port 56 is coupled to the outwardly facing surface 51 of the top member 50.

The charger 46 includes a power cord 58. The power cord 58 is electrically coupled to the power source, such as an electrical outlet. The band 22 is selectively positioned on the charger 46 such that the first charge port 42 engages the second charge port. Thus, the second charger 46 is placed in electrical communication with the battery 44 to charge the battery 44.

In use, the band 22 is positioned around the wrist of the second user when each of the second and first users is in a large, public area. The second button 34 on the band 22 is manipulated to turn the processor 30 on. The second transceiver 20 is placed in electrical communication with the extrinsic communication network 16 and is linked to the first transceiver 14. In this way the first user may track the location of the second user the large, public area.

The second user depresses the first button 32 for the minimum duration of time to notify the first user that the second user needs assistance. The second transceiver 20 communicates the physical location of the second user to the first user. In this way the first user may use a tracking app or the like on the electronic device 12 to locate the second user. The second user simultaneous depresses the first 32 and second 34 buttons when the second user needs emergency assistance, such as abduction or the like. Thus, the second transceiver 20 communicates the physical location of the second user to the emergency responders and the first user.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A child tracking system comprising:

an electronic device being configured to be manipulated by a first user, said electronic device having a first transceiver, said first transceiver being configured to be in electrical communication with an extrinsic communication network;

a tracking unit being configured to be worn on a second user, said tracking unit having a second transceiver, said second transceiver being configured to be in electrical communication with the extrinsic communication network, said tracking unit being in remote communication with said electronic device via the extrinsic communication network, said tracking unit selectively transmitting a first signal to said electronic device wherein said tracking unit is configured to alert the first user that the second user needs assistance, said tracking unit selectively transmitting a second signal to emergency responders via the extrinsic communication network wherein said tracking unit is configured to notify the emergency responders that the second user needs assistance, said tracking unit comprising a band being configured to be worn on a wrist, said band having an outwardly facing surface, a first lateral side and a second lateral side, and a processor being positioned within said band, said processor selectively generating a first alert sequence and a second alert sequence, a power supply being coupled to said band, said power supply being electrically coupled to said processor, said power supply comprising a first charge port being coupled to an inwardly facing surface of said band;

a charger, said charger having a first member extending between a top member and a bottom member, each of said top member and said bottom member extending away from said first member such that said charger has a U-shape, a second charge port being positioned on an upwardly facing surface of said top member, said first charge port being electrically engageable to said second charge port wherein said first charge port is configured for electrically coupling to a power source through said second charge port; and a power cord coupled to and extending from said charger, said power cord being in electrical communication with said second charge port and configured for electrically coupling to the power source.

2. The system according to claim 1, further comprising a first button being movably coupled to said first lateral side of said band wherein said first button is configured to be manipulated, said first button being electrically coupled to said processor, said processor generating said first alert sequence when said first button is depressed for a minimum duration of time.

3. The system according to claim 2, further comprising a second button being movably coupled to said second lateral side of said band wherein said second button is configured to be manipulated, said second button being electrically coupled to said processor, said processor generating said second alert sequence when said second button is depressed in conjunction with said first button.

4. The system according to claim 1, further comprising a touch screen being coupled to said outwardly facing surface wherein said touch screen is configured to be manipulated, said touch screen being electrically coupled to said processor thereby facilitating said touch screen to control operational parameters of said processor, said touch screen displaying indicia corresponding to operational parameters of said processor.

5. The system according to claim 1, further comprising a vibrating unit being positioned within said bracelet, said vibrating unit frictionally engaging said bracelet wherein said vibrating unit is configured to provide haptic feedback to the second user when said band is worn, said vibrating unit being electrically coupled to said processor, said processor turning said vibrating unit on when said processor generates said first alert sequence and said second alert sequence.

6. The system according to claim 1, wherein said second transceiver is positioned within said band, said second transceiver being electrically coupled to said processor, said second transceiver being configured to be in electrical communication with a global positioning system (gps) thereby facilitating said second transceiver to receive a physical location of said band from the gps.

7. The system according to claim 6, wherein said second transceiver communicates the physical location of said band to said first transceiver when said processor generates said first alert sequence.

8. The system according to claim 6, wherein said second transceiver communicates the physical location of said band to the emergency responders when said processor generates said second alert sequence.

9. The system according to claim 1, further comprising a battery being positioned within said band, said battery being electrically coupled to said first charge port such that said first charge port charges said battery when said first charge port is electrically coupled to the power source.

10. A child tracking system comprising:

an electronic device being configured to be manipulated by a first user, said electronic device having a first transceiver, said first transceiver being configured to be in electrical communication with an extrinsic communication network; and a tracking unit being configured to be worn on a second user, said tracking unit having a second transceiver, said second transceiver being configured to be in electrical communication with the extrinsic communication network, said tracking unit being in remote communication with said electronic device via the extrinsic communication network, said tracking unit selectively transmitting a first signal to said electronic device wherein said tracking unit is configured to alert the first user that the second user needs assistance, said tracking unit selectively transmitting a second signal to emergency responders via the extrinsic communication network wherein said tracking unit is configured to notify the emergency responders that the second user needs assistance, said tracking unit comprising:

a band being configured to be worn on a wrist, said band having an outwardly facing surface, a first lateral side and a second lateral side, a processor being positioned within said band, said processor selectively generating a first alert sequence and a second alert sequence, a first button being movably coupled to said first lateral side of said band wherein said first button is configured to be manipulated, said first button being electrically coupled to said processor, said processor generating said first alert sequence when said first button is depressed for a minimum duration of time, a second button being movably coupled to said second lateral side of said band wherein said second button is configured to be manipulated, said second button being electrically coupled to said processor, said processor generating said second alert sequence when said second button is depressed in conjunction with said first button, a touch screen being coupled to said outwardly facing surface wherein said touch screen is configured to be manipulated, said touch screen being electrically coupled to said processor thereby facilitating said touch screen to control operational parameters of said processor, said touch screen displaying indicia corresponding to operational parameters of said processor, a vibrating unit being positioned within said bracelet, said vibrating unit frictionally engaging said bracelet wherein said vibrating unit is configured to provide haptic feedback to the second user when said band is worn, said vibrating unit being electrically coupled to said processor, said processor turning said vibrating unit on when said processor generates said first alert sequence and said second alert sequence, said second transceiver being positioned within said band, said second transceiver being electrically coupled to said processor, said second transceiver being configured to be in electrical communication with a global positioning system (gps) thereby facilitating said second transceiver to receive a physical location of said band from the gps, said second transceiver communicating the physical location of said band to said first transceiver when said processor generates said first alert sequence, said second transceiver communicating the physical location of said band to the emergency responders when said processor generates said second alert sequence, and a power supply being coupled to said band, said power supply being electrically coupled to said processor, said power supply comprising:

a first charge port being coupled to said band, and a battery being positioned within said band, said battery being electrically coupled to said first charge port such that said first charge port charges said battery when said first charge port is electrically coupled to a power source;

a charger, said charger having a first member extending between a top member and a bottom member, each of said top member and said bottom member extending away from said first member such that said charger has a U-shape, a second charge port being positioned on an upwardly facing surface of said top member, said first charge port being electrically engageable to said second charge port wherein said first charge port is configured for electrically coupling to the power source through said second charge port; and a power cord coupled to and extending from said charger, said power cord being in electrical communication with said second charge port and configured for electrically coupling to the power source.

* * * * *